US006681436B2

(12) United States Patent
Nilsson

(10) Patent No.: US 6,681,436 B2
(45) Date of Patent: Jan. 27, 2004

(54) TOOTHBRUSH INCLUDING RETAINER AND DETACHABLE BRUSH

(75) Inventor: Åke Nilsson, Lund (SE)

(73) Assignee: Tepe Munhygienprodukter AB, Malmö (SE)

( * ) Notice: Subject to any disclaimer, the term of this patent is extended or adjusted under 35 U.S.C. 154(b) by 332 days.

(21) Appl. No.: 09/862,416

(22) Filed: May 23, 2001

(65) Prior Publication Data

US 2001/0052161 A1 Dec. 20, 2001

(30) Foreign Application Priority Data

Jun. 16, 2000 (EP) ..... 00850102

(51) Int. Cl.[7] ..... A46B 9/04
(52) U.S. Cl. ..... 15/167.1; 15/145; 15/176.5
(58) Field of Search ..... 15/167.1, 145, 15/176.1, 176.4, 176.5, 176.6; 132/321, 329

(56) References Cited

U.S. PATENT DOCUMENTS

| | | | | |
|---|---|---|---|---|
| 4,534,081 A | | 8/1985 | Spademan | 15/167.1 |
| 4,706,322 A | * | 11/1987 | Nicolas | 15/167.1 |
| 4,751,761 A | | 6/1988 | Breitschmid | 15/176 |
| 4,805,252 A | | 2/1989 | Tarrson et al. | 15/167.1 |
| 4,809,389 A | * | 3/1989 | Breitschmid | 15/167.1 |
| 5,090,080 A | * | 2/1992 | Thuresson et al. | 15/167.1 |
| 5,201,091 A | | 4/1993 | Tarrson et al. | 15/167.1 |
| 5,283,924 A | * | 2/1994 | Kaminski et al. | 15/167.1 |
| 5,394,584 A | * | 3/1995 | Breitschmid | 15/167.1 |
| 5,758,382 A | | 6/1998 | Maekawa et al. | 15/167.1 |

FOREIGN PATENT DOCUMENTS

DE 197 01 891 6/1998

* cited by examiner

*Primary Examiner*—Theresa T. Snider
(74) *Attorney, Agent, or Firm*—Burns, Doane, Swecker & Mathis, L.L.P.

(57) ABSTRACT

The invention depicts a detachable brush comprising a brush portion (60) and a fastening portion (50) that extends along a first axis (C). The fastening portion (50), in order to be retained by a handle, comprises a first surface **(52*a*) being angled in a first direction such that a normal of the first surface has at least a component in a first direction along said first axis (C), and a second surface (53*a*)** being angled in a second direction such that a normal of the second surface has at least a component in a second direction, opposite to the first direction, along said first axis (C). The invention further depicts a handle with retainer portions shaped to receive and carry the detachable brush.

13 Claims, 2 Drawing Sheets

TOOTHBRUSH INCLUDING RETAINER AND DETACHABLE BRUSH

TECHNICAL FIELD OF THE INVENTION

The invention relates to a toothbrush and in particular to an interdental toothbrush with a detachable brush. The invention further relates to a handle and to a brush, respectively, for an interdental toothbrush.

BACKGROUND ART

Some people have retracted gums, which leads to the formation of more or less open interspaces between the necks of adjacent teeth. As people grow old, the gums around the teeth tend to be more and more retracted, thereby exposing more of the necks, which leads to the formation of more open interspaces between the necks of adjacent teeth. A regular toothbrush is limited as to the tooth and gum surfaces that it can reach; in particular it cannot reach into the interspaces between the teeth. Even for people who do not have open interspaces between their teeth, regular toothbrushes are often not satisfactory as to in what extent they reach and clean around the necks of the teeth.

As a result, it is common to provide a small twisted wire brush that can reach into and through these interspaces. Twisted wire brushes are available in various shapes and sizes to accommodate the diverse needs of users, which vary upon the shape and the size of the teeth and the spacing between them. For example, some twisted wire brushes have a conical shape, while others have a cylindrical shape. Similarly, some brushes have relatively large brush and stem diameters, while others have smaller brush and stem diameters.

The brush is usually firmly arranged on one end of a longitudinal handle, concentric or at right angle to the longitudinal axis of the handle.

However, in addition to the different needs of different users, a single user may have relatively large interdental spaces at one place and relatively small interspaces at another place. Thus, it is desirable to provide an interdental brush with a handle that can interchangeably receive and carry different types of brushes.

An example of a interdental toothbrush with a detachable brush is described in U.S. Pat. No. 5,201,091 (Tarrson et al.). The handle has a hinged two-part locking retainer on the end of an elongated handle. The first part of the hinged locking retainer is integral with the handle and the second part is arranged to be folded back and retained adjacent to the first part. The locking retainer has a through hole located in the second part close to the hinge-axis and being arranged to receive the twisted wire forming the stem of the twisted wire brush. When the user is about to use the brush, the stem of the brush is inserted in the through hole and the portion of the stem extending past the hole is received in a slot in said first part of the retainer. Thereafter the second part of the retainer is folded back, thereby bending the stem of the brush. The bending of the stem of the brush prevents the brush from being retracted or further inserted when the interdental brush is used.

However, the bending of the stem is permanent and the brush can only be attached to the handle once. Thus, the user cannot use this type of interdental brush if there is a need for more than one size or shape of the brush.

Furthermore, it is difficult to place and hold the twisted wire stem of the brush in the correct position, before and while folding back the second part of the hinged locking retainer. This drawback is present even for young people with good eyesight and well functioning fingers, and is further pronounced since it is especially elderly people that need interdental brushes. The elderly people may have stiff or weak hands, impaired eyesight or other handicaps that limit their ability to manipulate the handle and the brush.

Another example of a interdental toothbrush with a detachable brush is described in U.S. Pat. No. 5,758,382 (Maekawa et al.). The handle has a hinged two-part locking retainer on the end of an elongated handle. The first part of the hinged locking retainer are integral with the handle and the second part is arranged to be folded back and retained adjacent the first part. The first part has two sidewalls arranged to extend on both sides of the second part in the folded position of the locking retainer. One of the sidewalls has a V-shaped gap for receiving the twisted wire stem of the brush. As the locking retainer is closed, the twisted wire stem is frictionally captured and clamped between the first and second part of the hinged locking retainer. Thus, it is the friction that retains the brush in the handle when the interdental brush is used. In order for the friction to be high enough, the locking retainer must exert a clamping force of high magnitude, which in turn implies that the locking retainer must be rigid and therefore also relatively large. The high magnitude of the clamping force also implies that the force needed to close the locking retainer is of considerable magnitude, which may be a problem, especially for older people.

In a preferred embodiment of the prior art the first part of the locking retainer has an indentation between the two opposing sidewalls and the second part has a protrusion in communication with the indentation. The indentation and protrusion interact and causes the twisted wire stem to be bent and locked in place when the locking retainer is closed. Thus, the user cannot use this type of interdental brush if there is a need for more than one size or shape of the brush.

SUMMARY OF THE INVENTION

The object of the invention is to solve the above mentioned problems related to the known interdental brushes.

A particular object of the invention is to provide an interdental brush by which a detachable brush can be detached and reattached several times.

The objects of the invention has been achieved in accordance with the invention by a detachable brush, a fastening portion for a detachable brush, a toothbrush retainer and a toothbrush.

In accordance with the invention, the object is achieved by a detachable brush comprising a brush portion and a fastening portion that extends along a first axis. The detachable brush is further characterised in that the fastening portion comprises a first surface, whose normal has at least a component in a first direction along said first axis, and a second surface, whose normal has at least a component in a second direction, opposite to the first direction, along said first axis.

The two surfaces directed in (at least partly) two directions along the first axis provides efficient retaining surfaces such that the detachable brush can be retained and prevented from being displaced back or forth along its first axis.

According to a preferred embodiment of the detachable brush, the fastening portion comprises a first central portion, with a first cross-section area, and two end portions, one on each side of the central portion along said first axis, with a second and a third cross-section area, respectively. The first cross-section area is different from the second and third cross-section areas, and said surfaces form junctions between the central portion and the end portions. This is a simple and robust way of providing the fastening portion with the necessary retaining surfaces. Furthermore, this embodiment makes the detachable brush easy to handle.

According to a preferred embodiment, the first surface is oriented such that its normal is directed along said first axis and that it forms a step that is perpendicular to said first axis. This step-shape makes it easy to place the detachable brush correctly on the toothbrush retainer unit. The step provides an unambiguous indication for the user, whether the detachable brush is correctly placed or not.

In the same manner it is preferred that also the second surface is oriented such that its normal is directed along said first axis and that it forms a step that is perpendicular to said first axis.

In accordance with another preferred embodiment, the first cross-section area is smaller than each of the second and the third cross-section areas. This is also related to the easiness of placing the brush and the user's feeling of correct placement or not. An item shaped this way is easy to place on a corresponding surface and the outer portions (the second and third portion) keeps the item in place.

It is preferred that the central portion has an extension along said first axis that exceeds the extension of each end portion along said first axis. This makes the detachable brush stable when received and carried by the toothbrush retainer.

The fastening portion of the detachable brush can be manufactured separately from the brush, which preferable is a twisted wire brush of known type, and then put together with the brush. Thus, in order to be used as a fastening portion for a detachable brush, the separate fastening portion presents the problem-solving features mentioned above in connection with the detachable brush.

In accordance with the invention, the object is also achieved by a toothbrush retainer comprising a first retainer portion connected to a second retainer portion, wherein the second retainer portion is foldable, relative to the first retainer portion, about a hinge axis, wherein the first and second retainer portions, when folded in a first, closed position, between them form an interspace, by which the retainer portions are adapted to retain a detachable brush. The tooth brush retainer is characterised in that the retainer portions, in order to retain a detachable brush, each comprise a first surface being angled in a first direction such that a normal of the first surface has at least a component in a first direction along said hinge axis, and a second surface being angled in a second direction such that a normal of the second surface has at least a component in a second direction, opposite to the first direction, along said hinge axis.

The two surfaces directed in (at least partly) two directions along the first axis provides efficient retaining surfaces such that the retainer portions can retain and prevent a detachable brush from being displaced back or forth along its first axis. Displacement of a detachable brush in other directions (forming an angle to said first axis) is prevented by the fact that the retainer portions between them form an interspace in which the detachable brush is adapted to be placed.

According to a preferred embodiment the retainer is connected to, and preferably integrated with, a longitudinal toothbrush handle in order to make the brush easier to use.

In the same manner as to the fastening portion, said first surface of the toothbrush retainer is preferably oriented such that its normal is directed along said hinge axis and that it forms a step that is perpendicular to said hinge axis.

Likewise the second surface is preferably oriented such that its normal is directed along said hinge axis and that it forms a step that is perpendicular to said hinge axis.

According to a preferred embodiment, the retainer portions are flat along the hinge axis and said first and second surfaces are formed by the side surfaces of the retainer portions. This shape of the retainer portions is easy to manufacture, it is easy to place a detachable brush onto such a shape, the detachable brush easily engages said retaining surfaces and the user feels at once if the detachable brush is placed correctly or not.

It is preferred that the retainer portions are angled an angle $\alpha$ relative to the handle about an axis that is normal to a geometric plane defined by the handle and the hinge axis. A preferred value of the angle $\alpha$ is about 10°. In this way the brush is inclined in respect of the handle, which makes it easier to reach interspaces further back in the mouth.

According to a preferred embodiment, the retainer portions and the interspace formed between them are symmetric along the hinge axis in respect of a plane that is centrally placed and is a normal plane to said hinge axis. In this way a detachable brush can be placed in the retainer in either direction, and the inclination of the brush relative to the handle can be utilised to its full extent. The user can choose between to different inclinations of the brush in respect of the handle, e.g. left-handed and right-handed people might have different needs, and the need of one user may vary as to brushing different teeth in different parts of the mouth.

In accordance with the invention, the object is also achieved by a toothbrush comprising a detachable brush, with a brush portion and a fastening portion that extends along a first axis, and a handle with a first retainer portion connected to a second retainer portion, wherein the second retainer portion is foldable, relative to the first retainer portion, about a hinge axis, wherein the first and second retainer portions, when folded in a first, closed position, between them form an interspace in which the detachable brush is retained. The toothbrush is characterised in that the retainer portions, in order to retain a detachable brush, comprise a first surface being angled in a first direction such that a normal of the first surface has at least a component in a first direction along said hinge axis, and a second surface being angled in a second direction such that a normal of the second surface has at least a component in a second direction, opposite to the first direction, along said hinge axis. Furthermore, the fastening portion of the detachable brush, in order to be retained, comprises a first surface being angled in a first direction such that a normal of the first surface has at least a component in a first direction along said first axis, and a second surface being angled in a second direction such that a normal of the second surface has at least a component in a second direction, opposite to the first direction, along said first axis. The brush is supported by the retainer portions such that the first axis and the hinge axis are essentially parallel, and preferably coincide, and in the first surface of the fastening portion and the second surface of the retainer portions face and abut or substantially abut each other, and the second surface of the fastening portion and the first surface of the retainer portions face and abut or substantially abut each other.

In this way the detachable brush is securely carried by the handle and the user can use a small brush with a large easy-to-grip handle. It is easy to place, and replace, the brush between the retainer portions. The brushes are not damaged by the insertion or clamping between the retainer portions. Thus, one brush can be inserted several times with ease. The consequence is that people who need different kinds of brushes at the same time can easily change brushes whenever needed.

BRIEF DESCRIPTION OF THE DRAWINGS

The invention will be described in further detail with reference to appended schematic drawings, showing a presently preferred embodiment of the invention.

DETAILED DESCRIPTION OF PREFERRED EMBODIMENT

Figure 1:
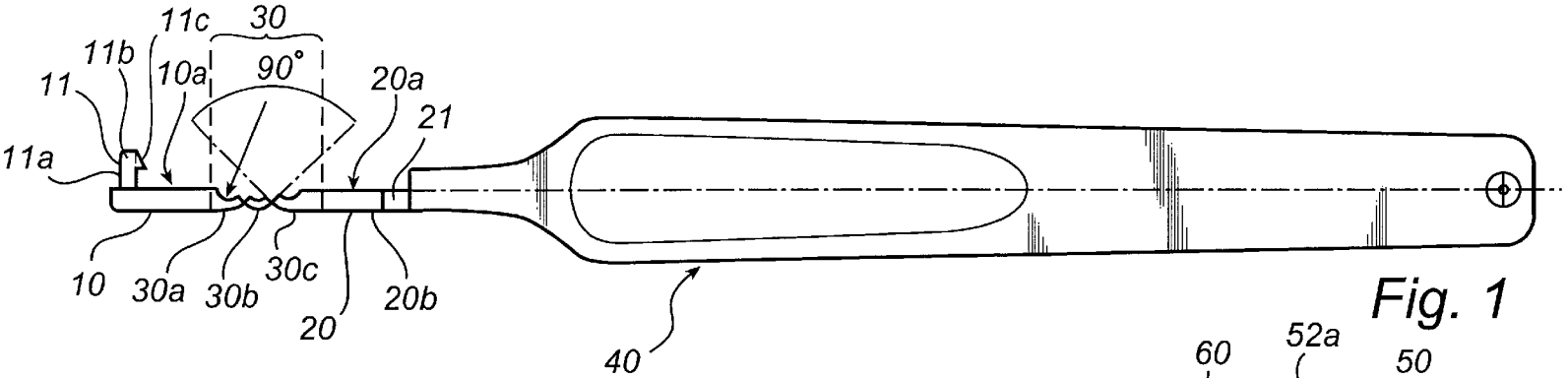
FIG. 1 is a view from above of the retainer portions formed in integral with the handle in accordance with a preferred embodiment of the invention.
Figure 4:
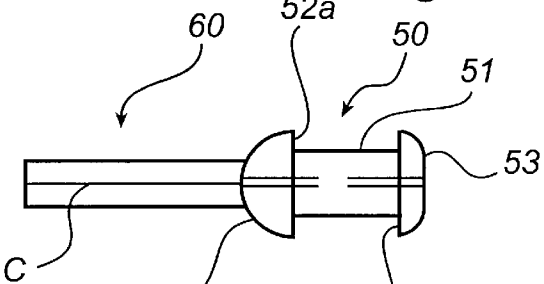
FIG. 4 is a side view of a detachable brush.
Figure 3:
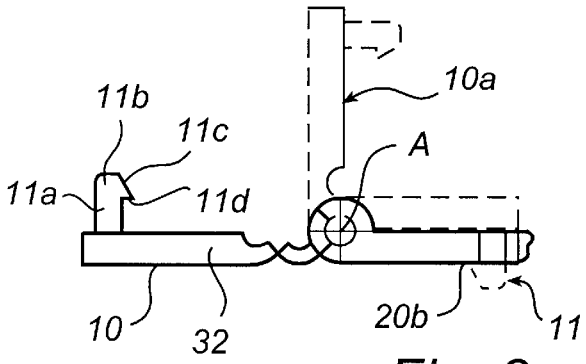
FIG. 3 is a view corresponding to FIG. 1, showing the retainer portions in an open, a halfway closed and a closed position.
Figure 7:
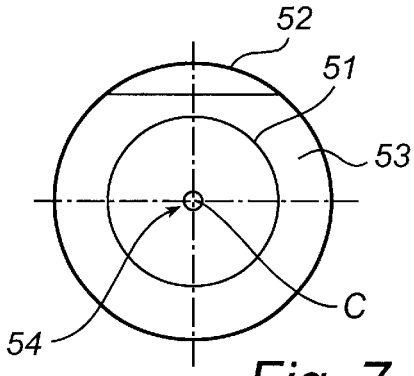
FIG. 7 is a bottom view of fastening portion shown in FIGS. 5–6.
Figure 6:
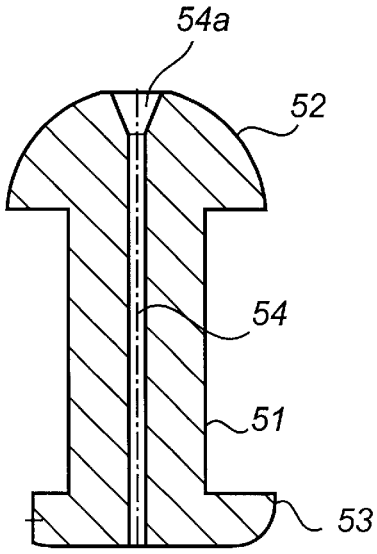
FIG. 6 is a cross-section along line VI—VI in FIG. 5.
Figure 5:
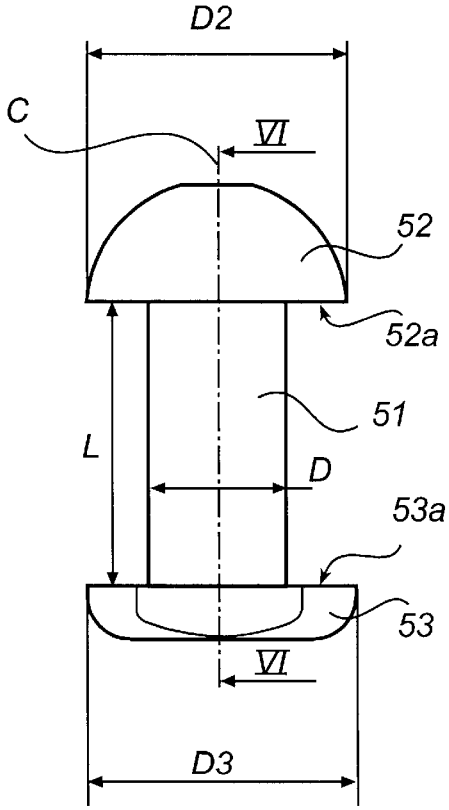
FIG. 5 is a side view of a fastening portion of a detachable brush.

The toothbrush retainer comprises a first retainer portion 10 connected to a second retainer portion 20 such that the retainer portions 10, 20 are foldable relative to each other (see FIGS. 1 and 3).

The first retainer portion 10 comprise a locking pin 11 arranged to be received in a locking recess 21 on the second retainer portion 20. The locking pin 11 and recess 21 are disposed on the retainer portions 10, 20 on the sides 10*a*, 20*a* facing each other in the closed position.

The locking recess 21 extends through the second retainer portion 20. The locking pin 11 comprises a resilient stem 11*a* and locking head 11*b* with an inclined top surface 11*c* and a locking tip 11*d*. The stem 11*a* is arranged to extend through the locking recess 21 and the second retainer portion 20, and the tip 11*d* is arranged to engage the backside 20*b* of the second retainer portion 20 and thereby holding the retainer portions 10, 20 in a closed condition. The tip lid is directed forward in the direction of the folding movement of the first retainer portion 10, i.e. the tip 11*d* is directed perpendicular to the hinge axis A.

The foldable connection between the retainer portions 10, 20 comprise a flexible hinge portion 30. The hinge portion 30 comprises three (or more) sub-portions 30*a*–*c*. Two of the portions 30*a*, 30*c* are formed in integral with the retainer portions 10, 20 and the other intermediate portion(-s) 30*b* connect the end portions 30*a*, 30*c* with each other. The sub-portions 30*a*–*c* have an arced shape, and their inner sides forms a part of a circle. When the retainer portions 10, 20 are folded together, the sub-portions 30*a*–*c* are arranged to form a tube, being open in both ends and extending along the axis A about which the first retainer portion 10 have been folded in respect of the second retainer portion 20.

The sub-portions 30*a*–*c* of the hinge portion 30 have uniform widths W along the hinge portion 30. The width W is measured along the hinge axis A. The tube, the sub-portions form in the closed position, have therefore plane surfaces 31, 32 at its two ends, the normals of the end or plane surfaces 31, 32 being parallel to the hinge axis A. Thus, the tube formed by the hinge sub-portions 30*a*–*c* have the shape of a straight, circular pipe with its ends parallel to a plane which normal is parallel to the centre axis of the pipe.

Figure 2:
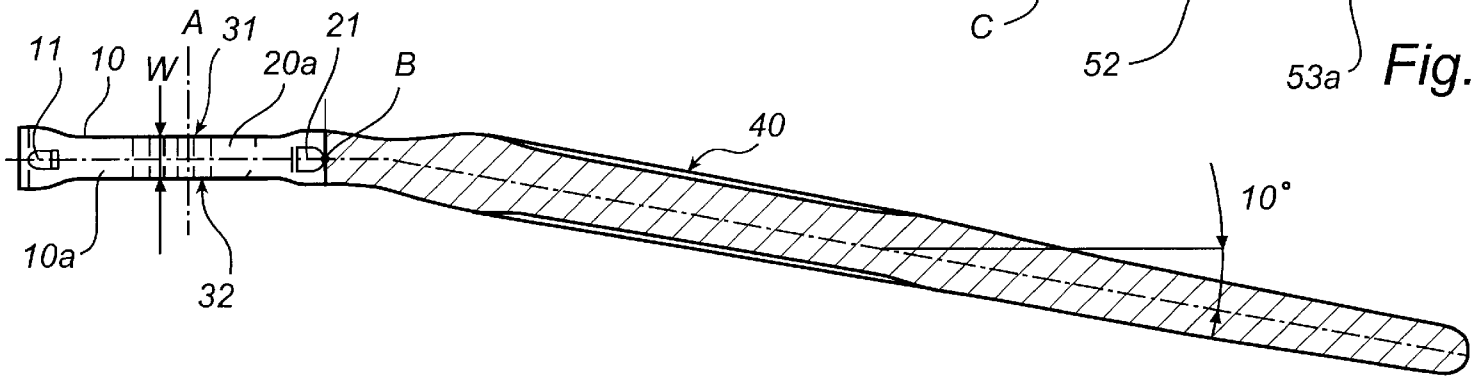
FIG. 2 is a cross-sectional view from one side of the retainer portions and the handle shown in FIG. 1.

The second retainer portion 20 is formed integrally with a handle 40. The handle 40 is longitudinal and has a substantially rectangular cross-section. The handle 40 is angled 10.degree. in one direction in respect of the retainer portions 10, 20 (see FIG. 2). The inclination is oriented such that, when the toothbrush is viewed in an elevational view, with the hinge axis normal to the plane of view (as in FIG. 1), the retainer portion 20 is parallel to the handle 40, and when the toothbrush is viewed in an elevational view, with the hinge axis in the plane of view (as in FIG. 2), the retainer portion 20 is inclined 10.degree. in respect of the second retainer portion 20. As can be seen in FIG. 1 and 2 the handle 40 is oriented such that the larger side of the cross-section is substantially parallel with a normal plane of the hinge axis A.

The above described toothbrush handle is arranged to carry a detachable interdental toothbrush.

The detachable brush comprises a fastening portion 50 and a brush portion 60. The brush portion 60 may be any conventional interdental brush, e.g. a two filament twisted wire with radially oriented bristles fixed between the twisted filaments. The brush portion 60 may have any shape suitable for different kinds of applications, e.g. it can have a substantially cylindrical or a substantially conical shape. Furthermore the length, rigidity, diameter etc. of the bristles can be varied to meet different requirements in different applications. Additionally it may be mentioned that the detachable brush is advantageously sold in a set of brushes of different size, shape etc. since most users have a demand for several different brushes. Usually the size of the interspaces varies in different parts of the mouth.

The fastening portion 50 of the detachable brush comprises an intermediate, cylindrical stem 51, a head portion 52, at the end of the stem 51 proximal the brush portion 60, and a heel portion 53, at the other end of the stem 51.

The stem 51 is arranged to be received in the tube formed by the retainer portions 10, 20 and the hinge portion 30. The stem 51 has a length L slightly exceeding the width W of the hinge portion 30. The stem 51 has a diameter D slightly smaller than the inner diameter of said tube.

The head portion 52 and heel portion 53 have a substantially half-spherical shape, with the flat surface attached to the stem 51. The diameters D2, D3 of the largest cross-section of the head and heel portions 52, 53 exceed the diameter of the stem 51, whereby two annular surfaces 52*a*, 53*a* are formed. The two annular surfaces 52*a*, 53*a* have normals parallel to the centre axis C of the stem 51 and they are facing each other.

In order for the brush portion 60 to be securely carried by the fastening portion 50, the fastening portion 50 has a through-hole 54 along its centre axis C. The hole 54 has a conical end 54*a* opening up towards the brush portion 60.

In use fastening portion 50 of a detachable brush is placed on the hinge portion 30, with the stem 51 resting on the hinge portion 30 and the head and heel portions 52, 53 on either side of the hinge portion 30. The length L of the stem 51 and the width W of the hinge portion 30 are adapted such that the fastening portion 50 is easy to place and remains in place after placement (the stem 51 is slightly longer than the width W of the hinge portion 30). The annular surfaces 52*a*, 53*b* of the head and heels portions 52, 53 abut or substantially abut the end of plane surfaces 31, 32 of the hinge portion 30, whereby any displacement of the fastening portion 50 along its centre axis C is avoided. Thereafter the first retainer portion 10 is folded on top of the second retainer portion 20 (see FIG. 3). The inclined top surface 11*c* of the locking tip 11*b* abuts the edge and the inside of the locking recess 21 of the second retainer portion 20 and guides the locking pin 11 intosaid locking recess 21. The locking procedure is completed when the first retainer portion 10 is completely folded on to the second retainer portion 20 and the locking tip 11*d* has snapped (by the resilience of the stem 11*a*) into engagement with the back side of the second retainer portion 20.

The fastening portion 50 can be oriented in either direction on the hinge portion 30. The inclination of the retainer portions 10, 20 in respect of the handle 40 makes it possible for the user to adjust the orientation of the brush, e.g. left-handed and right-handed persons might have different predilections regarding orientation, and furthermore one and the same person might want different orientations when brushing different teeth on different locations in his or her mouth.

The width W of the retainer portion is in the order of 2–10 mm. The length L of the intermediate stem portion of the fastening portion is in the order of 2–10 mm and the diameter D of the intermediate stem portion is in the order of 1.5–5 mm. In a preferred embodiment the width W is 5 mm, the length L is 5 mm and the diameter D is 2.5 mm.

It should be noted that several modifications of the described embodiments of the invention are possible within the scope of the invention being defined in the claims.

The fastening portion can for instance have other shapes forming the necessary abutment surfaces. In other embodiments the flat surfaces can be inclined in order to achieve a wedging engagement between the fastening portion and the retainer portions. In other embodiments the cross-section of the fastening portion and the hinge portion can be inverted (the stem has a larger diameter and the head and heel may even be eliminated) and the hinge portion and the retainer portions have an indentation with a shape corresponding to the stem.

What is claimed is:

1. Toothbrush retainer comprising a first retainer portion connected to a second retainer portion, the second retainer portion being foldable, relative to the first retainer portion, about a hinge axis, the retainer portions, when folded in a first, closed position, forming an interspace between them by which the retainer portions are adapted to retain a detachable brush, wherein the retainer portions, in order to retain the detachable brush, comprise a first surface that is angled in a first direction such that a normal of the first surface has at least a component in a first normal component direction along the hinge axis, and a second surface that is angled in a second direction such that a normal of the second surface has at least a component in a second normal component direction, opposite to the first normal component direction, along the hinge axis, wherein the retainer is associated with a longitudinal toothbrush handle, wherein the retainer portions are angled relative to the handle about an axis that is normal to a geometric plane defined by the handle and the hinge axis.

2. Toothbrush retainer according to claim 1, wherein the retainer is connected to the longitudinal toothbrush handle.

3. Toothbrush retainer according to claim 1, wherein the retainer is integrated with the longitudinal toothbrush handle.

4. Toothbrush retainer according to claim 1, wherein the first surface includes a step that is perpendicular to the hinge axis.

5. Toothbrush retainer according to claim 1, wherein the second surface includes a step that is perpendicular to the hinge axis.

6. Toothbrush retainer according to claim 1, wherein the retainer portions are flat along the hinge axis and the first and second surfaces are formed by side surfaces of the retainer portions.

7. Toothbrush retainer comprising a first retainer portion connected to a second retainer portion, the second retainer portion being foldable, relative to the first retainer portion, about a hinge axis, the retainer portions, when folded in a first, closed position, forming an interspace between them by which the retainer portions are adapted to retain a detachable brush, wherein the retainer portions, in order to retain the detachable brush, comprise a first surface that is angled in a first direction such that a normal of the first surface has at least a component in a first normal component direction along the hinge axis, and a second surface that is angled in a second direction such that a normal of the second surface has at least a component in a second normal component direction, opposite to the first normal component direction, along the hinge axis, wherein the retainer portions and the interspace formed between them are symmetric along the hinge axis in respect of a plane that is centrally placed and is a normal plane to the hinge axis.

8. Toothbrush retainer according to claim 7, wherein the retainer is connected to a longitudinal toothbrush handle.

9. Toothbrush retainer according to claim 7, wherein the retainer is integrated with a longitudinal toothbrush handle.

10. Toothbrush retainer according to claim 7, wherein the first surface includes a step that is perpendicular to the hinge axis.

11. Toothbrush retainer according to claim 7, wherein the second surface includes a step that is perpendicular to the hinge axis.

12. Toothbrush retainer according to claim 7, wherein the retainer portions are flat along the hinge axis and the first and second surfaces are formed by side surfaces of the retainer portions.

13. Toothbrush comprising a detachable brush, with a brush portion and a fastening portion that extends along a first axis, and a handle with a first retainer portion connected to a second retainer portion, wherein the second retainer portion is foldable, relative to the first retainer portion, about a hinge axis, wherein the first and second retainer portions, when folded in a first, closed position, between them form an interspace in which the detachable brush is retained, wherein the retainer portions, in order to retain a detachable brush, comprise a first retainer surface that is angled in a first retainer surface direction such that a normal of the first retainer surface has at least a component in a first normal direction along the hinge axis, and a second retainer surface that is angled in a second retainer surface direction such that a normal of the second retainer surface has at least a component in a second normal direction, opposite to the first normal direction, along the hinge axis, wherein the fastening portion of the detachable brush, in order to be retained, comprises a first fastening surface that is angled in a first fastening surface direction such that a normal of the first fastening surface has at least a component in a first fastening surface normal direction along the first axis, and a second fastening surface that is angled in a second fastening surface direction such that a normal of the second fastening surface has at least a component in a second fastening surface normal direction, opposite to the first fastening surface normal direction, along the first axis, wherein the brush is supported by the retainer portions such that the first axis and the hinge axis are essentially parallel, and wherein the first fastening surface of the fastening portion and the second retainer surface of the retainer portions face and at least substantially abut each other, and the second fastening surface of the fastening portion and the first retainer surface of the retainer portions face and at least substantially abut each other.

* * * * *